US011766141B2

(12) United States Patent
König

(10) Patent No.: US 11,766,141 B2
(45) Date of Patent: Sep. 26, 2023

(54) SET OF A SELF-ADHESIVE MAT AND A VESSEL

(71) Applicant: Marcus König, Graz (AT)

(72) Inventor: Marcus König, Graz (AT)

( * ) Notice: Subject to any disclaimer, the term of this patent is extended or adjusted under 35 U.S.C. 154(b) by 0 days.

(21) Appl. No.: 17/989,380

(22) Filed: Nov. 17, 2022

(65) Prior Publication Data

US 2023/0075111 A1 Mar. 9, 2023

Related U.S. Application Data

(63) Continuation of application No. 17/050,932, filed as application No. PCT/AT2019/060119 on Apr. 9, 2019, now abandoned.

(30) Foreign Application Priority Data

Apr. 27, 2018 (AT) ..... A 50360/2018

(51) Int. Cl.

| | |
|---|---|
| ***A47G 23/00*** | (2006.01) |
| ***A47G 19/10*** | (2006.01) |
| ***A47G 19/22*** | (2006.01) |
| ***A47G 23/03*** | (2006.01) |

(52) U.S. Cl.
CPC ..... *A47G 19/10* (2013.01); *A47G 19/2283* (2013.01); *A47G 23/0303* (2013.01)

(58) Field of Classification Search
None
See application file for complete search history.

(56) References Cited

U.S. PATENT DOCUMENTS

| | | | |
|---|---|---|---|
| 2,813,509 | A | 11/1957 | Bruno |
| 6,318,683 | B1 | 11/2001 | Savoy |
| 7,469,425 | B2 | 12/2008 | DeStefano |
| D812,433 | S | 3/2018 | Kwok |
| 2015/0351565 | A1 | 12/2015 | Scharfe et al. |
| 2016/0073805 | A1 | 3/2016 | Laurain |
| 2017/0042354 | A1 | 2/2017 | Bonnier et al. |
| 2018/0352984 | A1 | 12/2018 | Roaks |

FOREIGN PATENT DOCUMENTS

| | | |
|---|---|---|
| AU | 519393 | 6/2018 |
| CN | 201019419 | 2/2008 |
| CN | 201088424 | 7/2008 |
| CN | 201167809 | 12/2008 |
| CN | 102673967 | 9/2012 |
| CN | 204318268 | 5/2015 |
| CN | 106572781 | 4/2017 |
| CN | 206371790 | 8/2017 |

(Continued)

*Primary Examiner* — Alexander S Thomas
(74) *Attorney, Agent, or Firm* — GREENBLUM & BERNSTEIN, P.L.C.

(57) ABSTRACT

A set including self-adhesive mat and an object such a vessel, for example. The mat is formed at least partially from an elastically deformable material and on a bottom side has a smooth surface, and the object can be releasably fastened to a top side of the mat by a connection device. The connection device includes a receiving element and a connecting piece interacting therewith, which element and piece are in particular embodied such that they can be plugged into one another. To ensure a connection that is unable to be released by a small child, it is provided that the connection device is embodied to be lockable.

20 Claims, 3 Drawing Sheets

(56) References Cited

FOREIGN PATENT DOCUMENTS

| | | |
|---|---|---|
| EP | 3 415 043 | 12/2018 |
| ES | 1180458 | 4/2017 |
| WO | 01/34004 | 5/2001 |
| WO | 02/04309 | 1/2002 |
| WO | 2006/048637 | 5/2006 |
| WO | 2016/010585 | 1/2016 |
| WO | 2018/107190 | 6/2018 |

SET OF A SELF-ADHESIVE MAT AND A VESSEL

CROSS-REFERENCE TO RELATED APPLICATION

This application is a continuation of U.S. patent application Ser. No. 17/050,932, which is a U.S. National Stage of PCT/AT2019/060119 filed Apr. 9, 2019 now abandoned claiming the priority of Austria Application No. A 50360/2018 filed Apr. 27, 2018, the disclosures of which are expressly incorporated by reference herein in their entireties.

BACKGROUND

1. Field of the Invention

The invention relates to a set comprising an, in particular, self-adhesive mat and an object such as a vessel, for example, wherein the mat is formed at least partially from an elastically deformable material and on a bottom side has a smooth surface, and wherein the object can be releasably fastened to a top side of the mat by means of a connection device, wherein the connection device comprises a receiving element and a connecting piece interacting therewith, which element and piece are in particular embodied such that they can be plugged into one another.

2. Discussion of Background Information

From the prior art, elastic, self-adhesive mats with a vessel are known which adhere to a smooth surface, wherein the mat has a smooth bottom side so that the mat closes tightly with the surface and, when the mat is lifted, a partial vacuum thus forms, whereby the mat adheres to the surface. A mat of this type can only be detached from the surface by the mat being lifted at an edge.

With the aid of a mat of this type, an object such as a tray or a bowl, for example, that is connected to the mat can be fixed in place on a smooth surface or secured against sliding.

In WO 2016/010585 A1, for example, a one-piece device composed of a self-adhesive mat and a tray arranged on said mat is disclosed.

In addition, a two-piece set of a self-adhesive mat and a tray which can be fastened thereto for feeding small children is known.

A disadvantage of the two-piece device known from the prior art can in particular be seen in that the tray can be detached from the mat relatively easily. This can also be accomplished by a small child, for which reason the risk of the tray being tipped over and/or dropped on the ground together with the contents thereof is still present.

Although this problem is solved by a one-piece device according to the prior art, a handling of a one-piece device of this type proves to be particularly cumbersome due to the elastic nature of the mat. A further disadvantage is a large space requirement caused by the size of the mat and the height of the tray, mainly during a storage and cleaning of the device.

SUMMARY

Accordingly, the object of the invention is to enhance a two-piece set known from the prior art, so that the risk of the tray being dropped on the ground and/or tipped over is reduced.

The object is attained according to the invention in that, with a set of the type named at the outset, the connection device is embodied to be lockable.

One advantage attained with the set according to the invention can in particular be seen in that the object or the vessel can only be detached from the mat by an increased application of force and/or a release of a, preferably mechanical, locking mechanism. Thus, on the one hand, the vessel, such as a tray or a plate for example, is attached to the mat such that it is essentially unable to be detached by a small child. On the other hand, the mat and the vessel that can be fixed in place thereon can be stored and cleaned separately from one another, whereby a space requirement of a set of this type is minimized. Because of the smooth surface of the bottom side of the mat, the mat can be positioned in a slip-resistant and self-adhesive manner on a tabletop, for example. In this case, a self-adhesion of the mat can be achieved in that a sufficiently smooth surface is provided on the bottom side thereof, so that when an attempt is made to lift the mat in a position at a distance from the edge, for example at the vessel or the connection device, a vacuum forms which resists a full-area detachment of the mat.

The connection device can, for example, be embodied such that it can be detached by a rotating and preferably simultaneous pressing. Here, a downward pressure on the connection device, for example, can be required to enable the rotating. Alternatively, a lateral compressing or squeezing-together of the connection device can be necessary to enable the rotating. In addition, the connection device can be connectable by a plugging-together, and can be lockable using a mechanism. For this purpose, the connection device can be embodied as a pluggable connection, in particular as a clip fastener, click buckle, or snap lock.

It is advantageous if on the top side the mat comprises a raised edge which in particular is embodied to be outwardly beveled. This raised edge can, for example, serve as a barrier for grime or for food that is moved out of the vessel but not into a hungry mouth of the small child. If the raised edge is also outwardly beveled, a lateral contact area is minimized, which additionally hinders the detachment of the mat from the surface.

Furthermore, it can preferably be provided that the mat comprises a recess on the bottom side and a corresponding protrusion on the top side. Preferably, the recess and the protrusion are arranged in an edge region of the mat. To detach the mat from the surface, the protrusion can be pressed-in, whereby an edge of the mat lifts up in the region of the pressed-in protrusion. In this manner, the mat can be easily detached. The recess thus forms a detaching aid together with the protrusion.

It is beneficial if the connection device is designed as a twist lock, wherein the receiving element and the connecting piece are embodied such that they can rotate against one another. By embodying the connection device in this manner, a quick and easy connection of the object to the mat is enabled. Alternatively, the connection device can be embodied as a pluggable connection with a clip fastener, for example.

It is advantageous if the receiving element is arranged on the mat and the connecting piece is arranged on the object. Alternatively, it can be provided that the connecting piece is arranged on the mat and the receiving element is arranged on the object.

It has proven effective that the receiving element comprises a stop and/or a catch for the connecting piece. It is thus enabled that when the object is being connected to the mat, the connecting piece engages with the receiving element and, as a result, can only be released again by an increased application of force or a movement out of the catch.

To facilitate a handling during the connection of the mat to the object, it can be provided that the receiving element partially has a greater stiffness than the mat. For this purpose, it can be provided that the receiving element is at least partially formed from a tougher or stiffer material than the mat itself. To this end, the mat can be formed, for example, from a silicone, and/or the receiving element can be formed from a hard plastic, a curable plastic or a thermoplastic. The mat is thus particularly cost-efficient to produce, since the receiving element can be manufactured in large quantities from an economical material, preferably from a hard plastic.

It is advantageous if the receiving element is embodied to be essentially round and comprises a central, in particular hollow, pedestal. With a circular or round embodiment, a rotation of the connecting piece in the receiving element is rendered possible. The pedestal in this case essentially serves as a support for the object, wherein the pedestal essentially pushes the object upwards and thus fixes the connecting piece in place in the receiving element.

It is also advantageous if the pedestal is embodied to be partially elastically deformable, and if a ring which has a greater stiffness than the pedestal is provided, preferably along an upper edge of the pedestal. Normally, the ring is embodied to be rigid, so that it stabilizes the pedestal along the upper peripheral edge. To detach the object from the mat, or to move the receiving element out of the catch, it can be provided that the object must be pushed down. With the deformable embodiment of the pedestal, the pedestal can be pushed down, whereby a rotational movement and thus the detachment of the object from the mat is then rendered possible.

In order for it to only be possible to push the pedestal down to a limited extent, it can be provided that the receiving element comprises at least one, in particular multiple, spacers that are arranged on the bottom side of the mat, preferably in a cavity of the pedestal. In addition, it is beneficial if the at least one spacer is connected to the ring of the pedestal and extends through the mat or the pedestal. As a result of the spacer, it is ensured that the pedestal is not pressed-in farther than is necessary for a detachment of the vessel or object from the mat. A load on the pedestal is thus minimized and a durability of the set is increased.

It is advantageous if the receiving element comprises a receiving ring which on the lateral periphery is at least partially surrounded by the mat and has a greater stiffness than the mat. The receiving ring can, for example, be formed from a curable plastic or a thermoplastic. Because the receiving ring is laterally, in particular gaplessly, surrounded by the mat, an accumulation of grime and/or bacteria between the receiving ring and mat can be avoided.

To ensure that the object is firmly fixed in place on the mat, it can be provided that the connecting piece comprises an engaging element. This engaging element preferably engages with the catch of the receiving element, whereby the connecting piece is arrested in the receiving element. Here, it can be provided that the catch is embodied as an indentation and the engaging element as a pin which interacts with the indentation. Preferably, the indentation is oriented facing upward on the receiving ring and the pin is arranged on the connecting piece. In the region of the catch, the object is pressed upwards by the pedestal, and the pin is thus moved into the catch. To then detach the object from the mat, the object can be pushed down, whereby the pin is once again moved out of the catch.

Furthermore, it can be provided that the connecting piece comprises a guide element. This guide element can, for example, engage with an indentation provided therefor in the receiving element and can thus guide the connecting piece along a direction of rotation and perpendicular thereto.

In addition, it can be provided that the connecting piece is embodied to be essentially round and possibly comprises a central pedestal receiver. With the circular or round embodiment, it is ensured that the connecting piece can rotate in the receiving element. If the receiving element comprises a pedestal, it can be provided that the connecting piece comprises a corresponding central pedestal receiver.

It is furthermore advantageous if the connection device is embodied as a tamper-proof lock, in particular as a push-and-turn lock.

It is expedient if an intermediate layer is provided which is essentially embodied such that it can be arranged between the mat and the object. A surface area that is protected against soiling can thus be enlarged cost-effectively, since a large-area intermediate layer can be inserted and the mat itself does not need to be embodied in an enlarged manner. The intermediate layer can be inserted between the mat and the object and can thus be connected to the set. In this case, the intermediate layer can be embodied as a place mat or as a bib, for example. Through an interaction with the mat and the object, this intermediate layer can also possibly be secured therebetween in a positionally stable manner.

It is further advantageous if the intermediate layer comprises a hole through which a subregion of the object, in particular the connecting piece, can be guided. The object can thus be connected to the mat in the usual manner, wherein an edge of the hole surrounds the connecting piece and/or the receiving device. A connection of the object to the mat takes place through the hole in the intermediate layer. The intermediate layer is thus secured against slipping. To enable the connecting piece and/or the receiver to be guided through the hole, it is beneficial if a diameter of the hole in the intermediate layer is larger than the diameter of the connecting piece and/or the receiver. Normally, the diameter of the hole is smaller than the maximum diameter of the object. It is thus prevented that the intermediate layer can be pulled upwards over the object and then be detached or separated from the set without first removing the object from the mat.

A further advantage results if the intermediate layer is embodied as a bib with an openable neck cutout. The intermediate layer can thus be firmly connected to the set on the one side and, for example, placed around the neck of a child on the other side. The neck cutout can in particular be embodied to be easy to open. For this purpose, two sides of the neck cutout can be closeable with a connection, such as for example a clip fastener, magnetic fastener, one or more snaps, or the like. In this case, it can be provided that small pulling forces are enough to release this connection. It is also beneficial if the connection can be released with a pulling force of more than 100 N, preferably more than 75 N, particularly preferably with a pulling force of at least 25 N.

Preferably, the mat and the receiving element are embodied in an integrated manner. For example, the receiving element can be supplied and a material which forms the mat can be cast around the receiving element so that a preferably gapless transition is ensured between the receiving element and the mat. In a preferred embodiment, the receiving ring can be formed from a curable plastic or thermoplastic, and silicone can be cast around the receiving ring.

Embodiments are directed to a set that includes a self-adhesive mat; a vessel; and a connection device comprising a receiving element and a connecting piece to connect the vessel to the mat. The mat is formed at least partially from an elastically deformable material and, on a bottom side, has a smooth surface, and the connecting piece, which includes a pedestal receiver, is structured to interact with the receiving element to form a locking connection. The receiving element, which is embodied to be essentially round with a hollow cavity, includes a central pedestal that is partially elastically deformable, and a ring arranged along an upper edge of the central pedestal that has a greater stiffness than the pedestal. A depth of the pedestal receiver is smaller than a height of the pedestal, such that, when the vessel is connected to the mat, the pedestal is deformed by the pedestal receiver.

According to embodiments, on a top side, the mat may include a raised edge.

In other embodiments the mat may include a recess on the bottom side and a corresponding protrusion on the top side.

In accordance with embodiments, the connection device can be designed as a twist lock, wherein the receiving element and the connecting piece may be structured to rotate against one another.

According to other embodiments, the receiving element may be arranged on the mat and the connecting piece can be arranged on the vessel.

In accordance with other embodiments, the receiving element may include at least one of a stop or a catch for the connecting piece.

In still other embodiments, the receiving element may partially have a greater stiffness than the mat.

In embodiments, the receiving element can include includes comprises at least one spacer coupled to the ring to extend through the mat. The at least one spacer may include multiple spacers, and the multiple spacers may be arranged in the hollow cavity of the pedestal.

According to other embodiments, the connecting piece may include at least one of an engaging element or a guide element.

In other embodiments, the connection device can be embodied as a tamper-proof lock.

In further embodiments, the set can include an intermediate layer that is embodied as a bib with an openable neck cutout and is positionable between the mat and the object. The intermediate layer can have a hole through which a subregion of the receiving element is guidable. The subregion of the receiving element can be further connectable to the connecting piece. The connecting piece can include at least one of an engaging element or a guide element and the subregion of the receiving element comprises a guide having at least one of a stop or catch. The at least one of the engaging element and the guide element are movable along the guide element to the at least one of the stop or catch, thereby forming the locking connection.

According to still other embodiments, the raised edge is embodied to be outwardly beveled.

Embodiments are directed to a set that includes a self-adhesive mat; a vessel; and a connection device including a receiving element and a connecting piece to connect the vessel to the mat. The mat is formed at least partially from an elastically deformable material and, on a bottom side, has a smooth surface. The connecting piece, which includes a pedestal receiver and at least one of guiding elements or engaging elements, is structured to interact with the receiving element, and the receiving element, which is embodied to be essentially round with a hollow cavity, includes a central pedestal that is partially elastically deformable, a ring having a greater stiffness than the pedestal that is arranged along an upper edge of the central pedestal, and plural subregions discontinuously surrounding the central pedestal. The hollow cavity is defined by a pedestal wall including at least one step so that a diameter of the hollow cavity decreases as a distance of the pedestal wall from the bottom side increases. A depth of the pedestal receiver is smaller than a height of the pedestal, such that, when the vessel is connected to the mat, the pedestal is deformed by the pedestal receiver, and the at least one of the guiding elements and the engaging elements are configured to interact with the plural intermediate elements, so that by rotating the vessel relative to the mat a locking connection is effected.

According to embodiments, the mat may further include a detaching aid arranged in an edge region of the mat, the detaching aid can include a recess on the bottom side of the mat and a protrusion on a top side of the mat.

In other embodiments, the pedestal can be formed in one piece with the mat.

In accordance with still yet other embodiments, the pedestal wall further defines an outer surface of the pedestal, which comprises at least one step so that a diameter of the outer surface of the pedestal decreases as a distance of the pedestal wall from the bottom side increases.

Additional features, advantages and effects follow from the exemplary embodiments described below. In the drawings which are thereby referenced:

DETAILED DESCRIPTION

Figure 1:
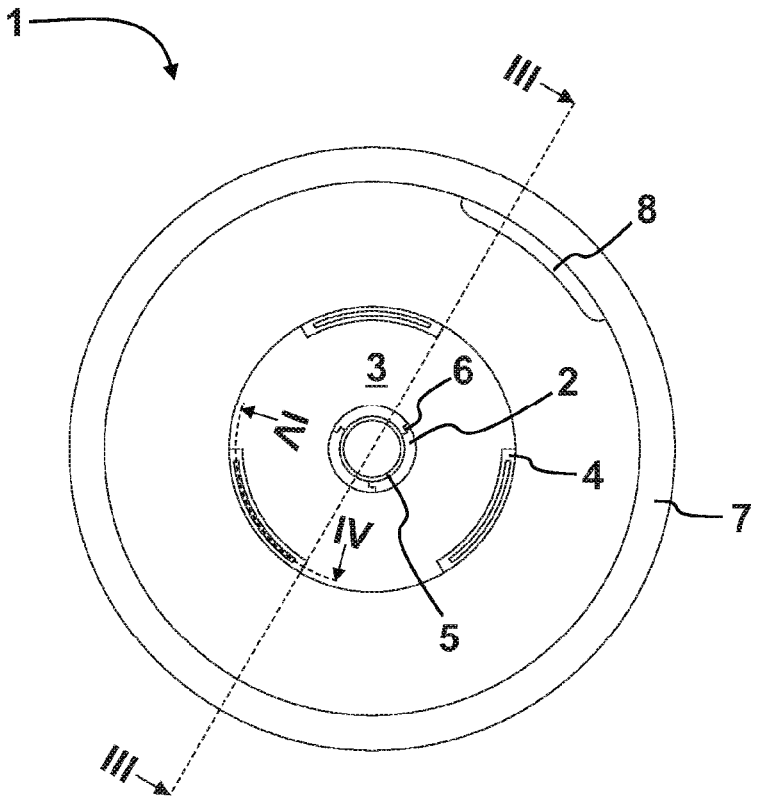
FIG. 1 shows a top view of a mat according to the invention.

FIG. 1 shows an, in particular, self-adhesive mat 1, wherein a top side of the mat 1 is illustrated. The mat 1 is embodied to be circular in the illustrated embodiment. Alternatively, the mat 1 can be designed in any desired shape, for example oval, rectangular or square. Here, the mat 1 has a preferably centrally arranged receiving element which typically comprises a pedestal 2 and a receiving ring 3. Particularly preferably, the receiving element is embodied to be essentially round or circular. The pedestal 2 is typically positioned in the middle of the receiving element and is possibly surrounded by the receiving ring 3. Normally, the receiving ring 3 comprises at least one, preferably three or more guiding means 4. For stabilization, the pedestal 2 comprises a rigid ring 5 which in particular is arranged along an upper edge of the pedestal 2. It has proven effective if the ring 5 and/or the receiving ring 3 are formed from a stiff material, for example from a hard plastic, a curable plastic, or a thermoplastic. In addition, it can be provided that the rigid ring 5 is connected to the receiving ring 3 via at least one, preferably multiple, ribs 6. It is advantageous if the ribs 6 are structured in three sections, wherein a first section and a third section run parallel in an offset manner and are connected by a second section. To simplify production, it can be provided that the ribs 6 are produced from the same material as the ring 5. Alternatively, the ring 5, the ribs 6, and optionally the receiving ring 3 are embodied in one piece, but preferably with different material thicknesses. In this case, the first section and the second section, and the second section and the third section, typically each form an angle of approximately 90°. Around the entire perimeter of the receiving element, an area is provided which is bounded by a raised edge 7. The raised edge 7 is preferably embodied to be radially beveled in an outward direction. Furthermore, a detaching aid 8 that comprises a protrusion on the top side of the mat 1 is normally provided.

Figure 2:
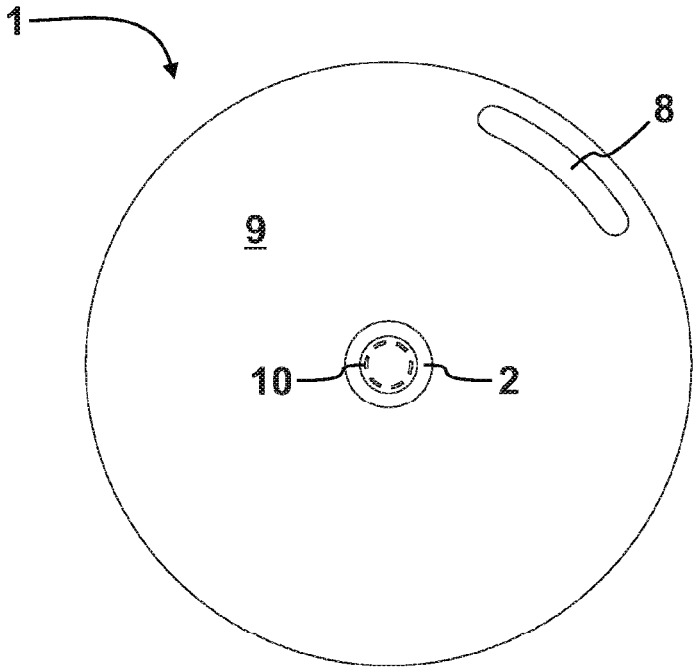
FIG. 2 shows a view of a bottom side of the mat according to the invention.

FIG. 2 shows a view of a bottom side of the mat 1, wherein a smooth surface 9 that is essentially ring-shaped is provided, which surface 9 surrounds the central pedestal 2. In an edge region, the detaching aid 8 is once again provided, which comprises a recess on the bottom side of the mat 1. In this case, multiple spacers 10 are provided on the pedestal 2, which spacers 10 are also arranged along a circle. The spacers 10 are preferably connected to the rigid ring 5 and extend through the mat 1, in particular in a region of the pedestal 2.

Figure 3:
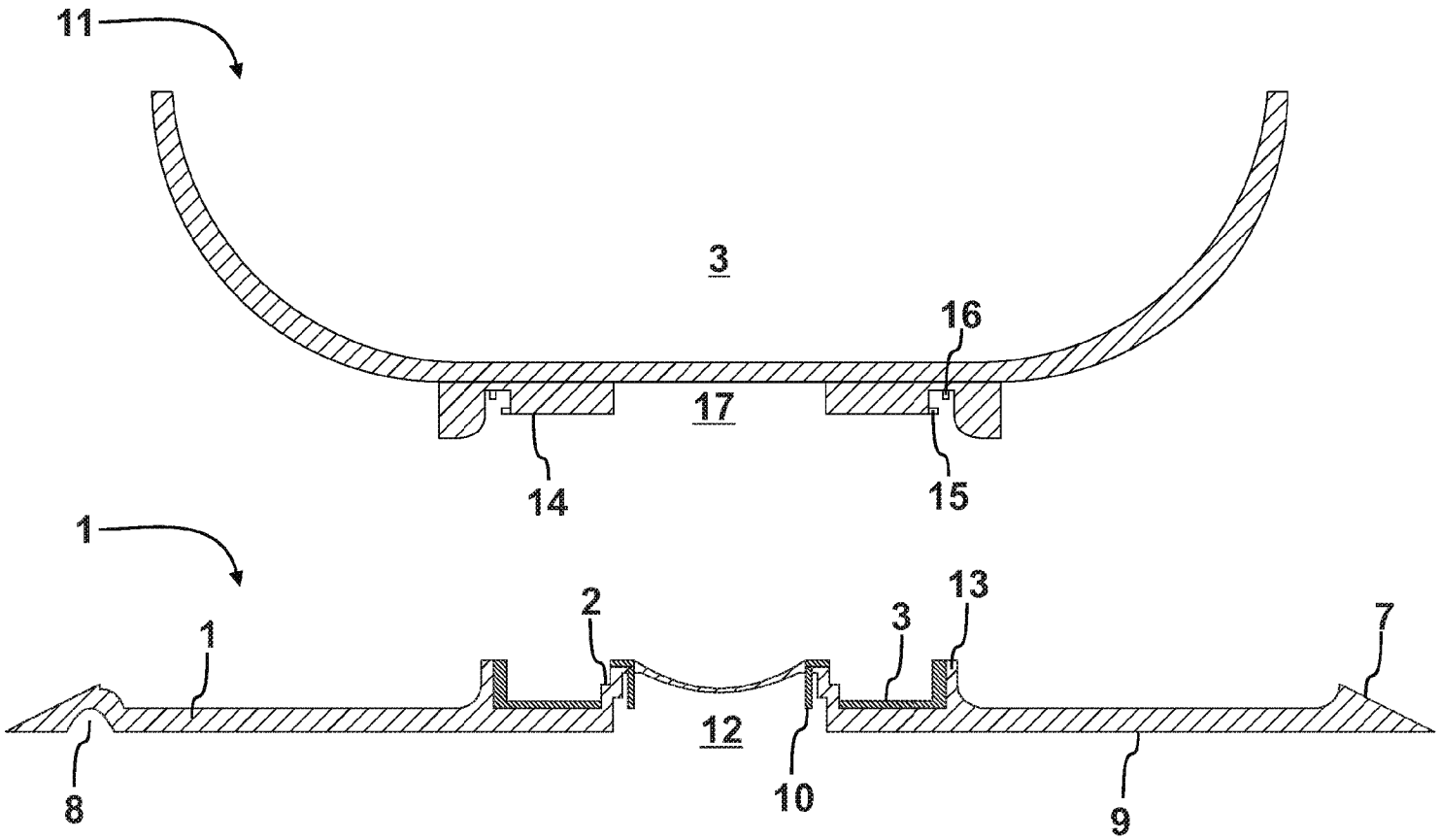
FIG. 3 shows a cross section through the mat and an object.

FIG. 3 shows a cross section through a set according to the invention, comprising the mat 1 and an object 11, for example a vessel, along the dashed line illustrated in FIG. 1. The object 11 is preferably embodied as a tray, plate, bowl, cup, dish, or the like. On the bottom side of the mat 1, the smooth surface 9 is typically provided which is interrupted or discontinued in the region of the pedestal 2, so that the smooth surface 9 is embodied to be essentially ring-shaped. The pedestal 2 is embodied to be essentially hollow, whereby a cavity 12 is provided in the middle of the mat 1. Particularly preferably, the pedestal 2 comprises one or more steps, wherein each second section of the ribs 6 runs along one step. On the top side of the mat 1, the receiving ring 3 is arranged, which receiving ring 3 surrounds the pedestal 2. The receiving ring 3 is furthermore surrounded by the mat 1. For this purpose, the mat 1 is bent up and essentially comprises a, typically circular, flap 13 in which the receiving ring 3 is positioned. The pedestal 2 is essentially embodied in one piece with the mat 1, wherein the mat 1 is embodied to be thinner in one section that is arranged essentially horizontally than in a remaining region, so that this section sags slightly downward. At the upper edge of the pedestal 2, in particular for the stabilization of the same, the rigid ring 5 is positioned which is connected to or embodied in one piece with multiple spacers 10 extending through the mat 1. In an edge region, the mat 1 is bounded by the raised edge 7, wherein this edge 7 is embodied to be radially beveled in an outward direction. The detaching aid 8 is provided in the edge region, wherein the protrusion of the detaching aid 8 is positioned on the top side and the indentation of the detaching aid 8 on the bottom side of the mat 1.

The object 11 or the vessel that can be fastened to the mat 1 preferably comprises a connecting piece 14 that corresponds to or interacts with the receiving element. In addition, on the connecting piece 14 one or more engaging elements 15 and/or guide elements 16 can be provided which serve to fix in place and/or guide the connecting piece 14 in the receiving element. The engaging elements 15 and/or the guide elements 16 are embodied as pins, for example. Furthermore, a pedestal receiver 17 can be provided in the middle of the connecting piece 14, which pedestal receiver 17 is embodied as an indentation, in particular corresponding to the pedestal 2. Preferably, the pedestal 2 fits perfectly into the pedestal receiver 17 when the object 11 is connected to the mat 1, wherein a depth of the pedestal receiver 17 is typically embodied to be smaller than a height of the pedestal 2, so that the pedestal 2 is deformed during the connection of the object 11 to the mat 1.

Figure 4:
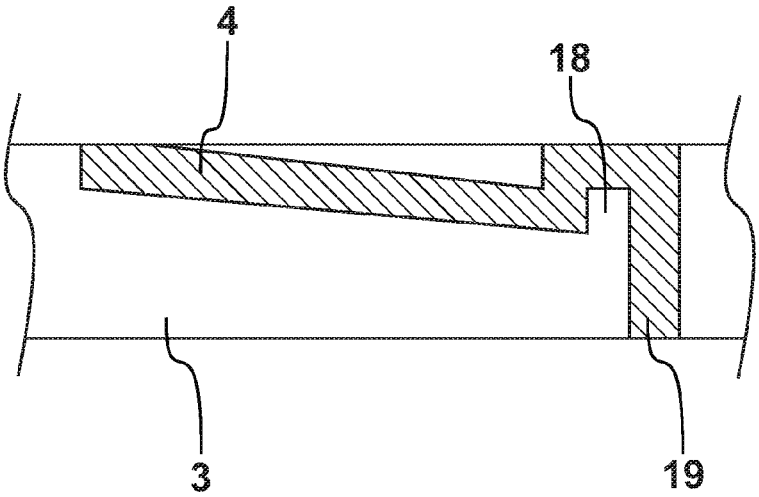
FIG. 4 shows a cross section through a subregion of the receiving element.

FIG. 4 shows a projection of a cross section through a subregion of the receiving element along the dashed line IV-IV illustrated in FIG. 1. In this subregion, one of the guiding means 4 is provided which guides guide elements 16 that are arranged on the connecting element and correspond to this guiding means 4. The guiding means 4 is typically embodied to be beveled, wherein the guide elements 16 preferably engage with the guiding means 4 from above when the object 11 is connected to the mat 1. A stop 19 and/or a catch 18 are furthermore provided. The catch 18 is in this case embodied as an indentation with which the engaging element 15, such as the pin for example, of the connecting piece 14 can engage.

To fasten the object 11 or the vessel to the mat 1, the object or vessel is first inserted with the connecting piece 14 into the receiving element. The object 11 can then be rotated in a first direction, for example clockwise, whereby the connecting piece 14 rotates in the receiving element. The guide elements 16 thereby engage with the guiding means 4 from above and the engaging elements 15 engage with the guiding means 4 laterally, so that the object 11 is pressed downwards together with the connecting piece 14. Here, the pedestal 2 is at the same time deformed by the connecting piece 14, and is likewise pressed downwards. A rotation in this case preferably takes place until the engaging element 15 strikes the stop 19 and engages with the catch 18. At the stop 19, the object 11 is pushed up again by the pedestal 2, whereby the engaging element 15 engages with the catch 18.

To detach the object 11 or the vessel from the mat 1, the object or vessel is first pushed down. As a result, the engaging element 15 is moved out of the catch 18 on the one hand, and the pedestal 2 is deformed on the other hand. The object 11 can then be rotated in a second direction, for example counterclockwise, wherein the object 11 is moved upwards again by the guide elements 16 and the corresponding beveled guiding means 4. Here, the pedestal 2 also once again returns to an original position or shape.

Thus, with a set according to the invention, small children can be fed safely and conveniently, wherein the children at the same time learn how to eat on their own without there being the risk of a tray filled with porridge, for example, being tipped over or dropped on the ground, since the tray is firmly connected to the self-adhesive mat 1. To clean and/or stow away the set, the tray or the object 11 can be easily detached from the mat 1 by an adult through a release of the connection device, and can subsequently be stored or cleaned, in a dishwasher for example, separately from one another and therefore in a space-saving manner. Because the set is embodied in two pieces, the mat 1 can, for example when the small child is being fed, remain in place on a tabletop while the object 11 is replaced. For example, an appetizer bowl can be removed and a main-course bowl can be fixed in place on the mat 1.

What is claimed:

1. A set comprising:

a self-adhesive mat; and a vessel;

a connection device comprising a receiving element and a connecting piece to connect the vessel to the mat, wherein the mat is formed at least partially from an elastically deformable material and, on a bottom side, has a smooth surface, wherein the connecting piece, which comprises a pedestal receiver, is structured to interact with the receiving element to form a locking connection, wherein the receiving element, which is embodied to be essentially round with a hollow cavity, comprises a central pedestal that is partially elastically deformable and a ring arranged along an upper edge of the central pedestal that has a greater stiffness than the pedestal, and wherein a depth of the pedestal receiver is smaller than a height of the pedestal, such that, when the vessel is connected to the mat, the pedestal is deformed by the pedestal receiver.

2. The set according to claim 1, wherein on a top side, the mat comprises a raised edge.

3. The set according to claim 2, wherein the raised edge is embodied to be outwardly beveled.

4. The set according to claim 1, wherein the mat comprises a recess on the bottom side and a corresponding protrusion on the top side.

5. The set according to claim 1, wherein the connection device is designed as a twist lock, wherein the receiving element and the connecting piece are structured to rotate against one another.

6. The set according to claim 1, wherein the receiving element is arranged on the mat and the connecting piece is arranged on the vessel.

7. The set according to claim 1, wherein the receiving element comprises at least one of a stop or a catch for the connecting piece.

8. The set according to claim 1, wherein the receiving element partially has a greater stiffness than the mat.

9. The set according to claim 1, wherein the receiving element comprises at least one spacer coupled to the ring to extend through the mat.

10. The set according to claim 9, wherein the at least one spacer comprises multiple spacers.

11. The set according to claim 10, wherein the multiple spacers are arranged in the hollow cavity of the pedestal.

12. The set according to claim 1, wherein the connecting piece comprises at least one of an engaging element or a guide element.

13. The set according to claim 1, wherein the connection device is embodied as a tamper-proof lock.

14. The set according to claim 1, further comprising an intermediate layer that is embodied as a bib with an openable neck cutout and is positionable between the mat and the vessel, the intermediate layer comprising a hole through which a subregion of the receiving element is guidable.

15. The set according to claim 14, wherein the subregion of the receiving element is further connectable to the connecting piece.

16. The set according to claim 15, wherein the connecting piece comprises at least one of an engaging element or a guide element and the subregion of the receiving element comprises a guide having at least one of a stop or catch, wherein the at least one of the engaging element and the guide element are movable along the guide element to the at least one of the stop or catch, thereby forming the locking connection.

17. A set comprising:

a self-adhesive mat; and a vessel;

a connection device comprising a receiving element and a connecting piece to connect the vessel to the mat, wherein the mat is formed at least partially from an elastically deformable material and, on a bottom side, has a smooth surface, wherein the connecting piece, which comprises a pedestal receiver and at least one of guiding elements or engaging elements, is structured to interact with the receiving element, wherein the receiving element, which is embodied to be essentially round with a hollow cavity, comprises a central pedestal that is partially elastically deformable, a ring having a greater stiffness than the pedestal that is arranged along an upper edge of the central pedestal, and plural subregions discontinuously surrounding the central pedestal, wherein the hollow cavity is defined by a pedestal wall comprising at least one step so that a diameter of the hollow cavity decreases as a distance of the pedestal wall from the bottom side increases, wherein a depth of the pedestal receiver is smaller than a height of the pedestal, such that, when the vessel is connected to the mat, the pedestal is deformed by the pedestal receiver, and wherein the at least one of the guiding elements and the engaging elements are configured to interact with the plural intermediate elements, so that by rotating the vessel relative to the mat a locking connection is effected.

18. The set according to claim 17, wherein the mat further comprises a detaching aid arranged in an edge region of the mat, the detaching aid comprising a recess on the bottom side of the mat and a protrusion on a top side of the mat.

19. The set according to claim 17, wherein the pedestal is formed in one piece with the mat.

20. The set according to claim 17, wherein the pedestal wall further defines an outer surface of the pedestal, which comprises at least one step so that a diameter of the outer surface of the pedestal decreases as a distance of the pedestal wall from the bottom side increases.

* * * * *